US005188520A

United States Patent [19]

Nakamura et al.

[11] Patent Number: 5,188,520

[45] Date of Patent: Feb. 23, 1993

[54] SCROLL TYPE COMPRESSOR WITH FRAMES SUPPORTING THE CRANKSHAFT

[75] Inventors: Toshiyuki Nakamura; Takashi Yamamoto; Hiroshi Ogawa; Norihide Kobayashi; Fumiaki Sano; Masahiko Oide; Katsuyoshi Wada; Minoru Ishii, all of Shizuoka, Japan

[73] Assignee: Mitsubishi Denki Kabushiki Kaisha, Tokyo, Japan

[21] Appl. No.: 721,140

[22] Filed: Jun. 26, 1991

[30] Foreign Application Priority Data

Jul. 13, 1990 [JP] Japan ..... 2-186181

[51] Int. Cl.[5] ..... F04C 18/04

[52] U.S. Cl. ..... 418/55.1; 29/888.022

[58] Field of Search ..... 418/55.1, 55.6; 417/902; 29/888.022

[56] References Cited

U.S. PATENT DOCUMENTS

| | | | |
|---|---|---|---|
| 4,431,388 | 2/1984 | Eber et al. | 418/55.1 |
| 4,552,518 | 11/1985 | Utter | 418/55.6 |
| 4,702,683 | 10/1987 | Inaba et al. | 418/57 |
| 4,743,181 | 5/1988 | Murayama et al. | 418/55.6 |
| 4,767,293 | 8/1988 | Caillat et al. | 418/57 |

FOREIGN PATENT DOCUMENTS

| | | | |
|---|---|---|---|
| 62-150001 | 7/1987 | Japan | 418/55.1 |
| 63-243481 | 10/1988 | Japan | 418/55.1 |

*Primary Examiner*—John J. Vrablik

*Attorney, Agent, or Firm*—Oblon, Spivak, McClelland, Maier & Neustadt

[57] ABSTRACT

A scroll type compressor comprising: a fixed scroll and an orbiting scroll which have their base plates provided with wraps thereon, the wraps being combined to form a compression chamber therebetween; a frame for fixedly supporting the fixed scroll, the frame having a bearing at a central portion; a crankshaft supported by the frame bearing to be rotatable, and having an electric motor rotor to give torque to the orbiting scroll; a subframe having a central portion provided with a bearing for supporting a lower end of the crankshaft; a center shell having a terminal member and an electric motor stator, having an inner peripheral surface formed with a stepped portion to be engaged with a stepped portion formed on an outer peripheral surface of the frame, the center shell having the frame fixed thereto by shrinkage fit at a location above or below the stepped portion of the center shell, and also having the subframe fixed to a lower end thereof; and concentric assemblage jig mounting portions formed in the frame and the subframe, respectively, to be concentric with the bearings.

2 Claims, 13 Drawing Sheets

SCROLL TYPE COMPRESSOR WITH FRAMES SUPPORTING THE CRANKSHAFT

The present invention is related to a scroll type compressor which can be utilized in a refrigerator and an air conditioner, the compressor having a hermetic housing separated into a high pressure space and a low pressure space, and a crankshaft supported at opposite ends so as to sandwich an electric motor unit.

Referring to FIG. 6, there is shown a longitudinal cross sectional view of a conventional scroll type compressor which has been disclosed in e.g. Japanese Unexamined Patent Publication No. 32691/1984. FIG. 7 is a longitudinal cross sectional view of socket and spigot joints as the essential parts of the compressor. In FIGS. 6 and 7, reference numeral 1 designates a fixed scroll which comprises a base plate 1*a* and a scroll wrap 1*b*. Reference numeral 2 designates an orbiting scroll which comprises a base plate 2*a*, a scroll wrap 2*b* and an axial portion 2*c*. The scroll wraps 1*b* and 2*b* are reverse to each other in the direction in which the wraps are wound. Between the wraps is formed a compression chamber 45. Reference numeral 3 designates a discharge port which is formed in the base plate 1*a* of the fixed scroll 1. Reference numeral 7 designates a frame for fixedly arranging the fixed scroll 1. Reference numeral 13 designates a bearing which is located at a central portion of the frame 7 Reference numeral 6 designates a crankshaft which has an intermediate portion provided with an electric motor rotor 8, and which is rotatably supported by the frame 7 and the bearing 13. Reference numeral 23 designates a center shell, at whose upper end the frame 7 is fixedly arranged, and at whose intermediate portion an electric motor stator 9 is supported. Reference numeral 27 designates a subframe which is fixedly arranged at a lower end of the center shell, and which has an intermediate portion formed with a bearing 39 for supporting a lower end of the crankshaft 6. Reference numeral 7*a* designates a spigot which is formed on the frame 7 for connection with the center shell 23. Reference numeral 27*a* designates a spigot which is formed on the subframe 27 for connection with the center shell 23. Reference numeral 20 designates a discharge chamber which is mounted to the fixed scroll 1 at the side remote from the orbiting scroll Reference numeral 40 designates a low pressure space Reference numeral 41 designates a high pressure space. Reference numeral 42 designates a sealing member.

In operation, the crankshaft 6 which is driven by combination of the electric motor stator 9 supported at the intermediate portion of the center shell 23 and the electric motor rotor 8 fixed on the intermediate portion of the crankshaft 6 rotates while being supported by the bearing 13 of the frame 7 and the bearing 39 of the subframe 27. As a result, the orbiting scroll 2 which has the axial portion 2*c* eccentrically supported in an upper portion of the crankshaft 6 carries out orbiting movement to form the compression chamber 45 between the fixed scroll 1 and the orbiting scroll 2. A low pressure refrigerant gas which is in the low pressure space 40 is inspired into the compression chamber 45 by the action of compression between the fixed scroll 1 and the orbiting scroll 2, is compressed into a high pressure refrigerant gas, and then is discharged from the discharge port 3 into the high pressure space 41. The low pressure refrigerant gas in the low pressure space 40 and the high pressure refrigerant gas in the high pressure space 41 are hermetically separated from each other by the fixed scroll 1, the frame 7 and the sealing member 42. The spigot 7*a* of the frame 7 has coaxiality, perpendicularly, roundness and flatness with respect to the bearing 13 of the frame 7 assured by machining accuracy. The spigot 27*a* of the subframe 27 has coaxiality, perpendicularity, roundness and flatness with respect to the bearing 39 of the subframe 27 assured by machining accuracy. The opposite end surfaces of the center shell 23 have parallelism, flatness assured by machining accuracy, and the center shell has the roundness of the inner peripheral surface assured by machining accuracy. This arrangement assures the coaxiality and the perpendicularity between the bearing 13 of the frame 7 and the bearing 39 of the subframe 27, allowing the crankshaft 6 to smoothly rotate between both bearings 13 and 39.

Referring now to FIG. 8, there is shown another conventional compressor which has been disclosed in Japanese Unexamined Patent Publication No. 173585/1982. Reference numeral 14 designates an intake port which is formed in the fixed scroll 1. Reference numeral 15 designates a thrust bearing which is provided on the frame 7 to support the orbiting scroll 2. The crankshaft 6, which rotates together with the rotor 8 as one unit and has a coupling member 21 mounted thereon, has an upper portion provided with an enlarged portion 6*a*. The enlarged portion 6*a* is supported by the frame 7 at its periphery through a sleeve bearing 16, and has an eccentric hole 6*b* formed therein to transmit orbiting movement to the axial portion 2*c* through an orbiting bearing 17. Reference numeral 18 designates an Oldham's coupling which prevents the orbiting scroll 2 from rotating. Reference numeral 19 designates a balancer which is mounted to the crankshaft 6 through the coupling member 21 and, which establishes balance with respect to the eccentric revolution of the orbiting scroll 2.

In the conventional compressor of FIG. 8, the crankshaft 6 is rotated by a driving source to give the orbiting movement to the orbiting scroll 2, thereby causing the orbiting scroll 2 to orbit. As shown in FIG. 9, the scroll wrap 1*b* of the fixed scroll 1 and the scroll wrap 2*b* of the orbiting scroll 2 are combined to be 180° out of phase, and the orbiting scroll 2 orbits about a fixed point P on the fixed scroll 1, using a fixed point Q on the orbiting scroll 2 as a cardinal point. Such arrangement causes the compression chamber 45 to be formed in a crescent shape between the spiral wraps 1*b* and 2*b* to inspire a fluid through the intake port 14. The fluid gradually moves toward the center along the spiral wraps while the area of the compression chamber is gradually decreased. Then the fluid is discharged from the discharge port 3 which is formed in a central portion of the fixed scroll 1. At that time, a thrust is applied to the orbiting scroll 2 by the pressure of the compressed fluid in the compression chamber 45. The thrust is received by the thrust bearing 15. An axial gap which is formed between end surfaces 1*c*, 2*d* of the opposite spiral wraps 1*b*, 2*b* and inner surfaces 1*d*, 2*e* of the base plates 1*a*, 2*a* is minimized by axial dimension control to avoid leakage.

Referring now to FIG. 14, there is shown another conventional scroll type compressor which has been disclosed in Japanese Unexamined Patent Publication No. 196488/1988. Reference numeral 36 designates an oil pump which is arranged at the lower end of the crankshaft 6. Reference numeral 37 designates a bolt. Reference numeral 38 designates a sealing terminal which is formed in the discharge chamber. Reference numeral 43 designates a discharge pipe. Reference numeral 46 designates a bolt. Reference numeral 47 designates a subframe. Other parts are similar to the parts indicated by the same reference numerals as the conventional compressors stated above.

In the structure shown in FIG. 14, the fixed scroll 1 is fastened together with the frame 7 and the subframe 47 by the bolts 46 through the orbiting scroll 2. The Oldham's coupling 35 is arranged between the base plate 2a of the orbiting scroll 2 and the frame 7 to prevent the orbiting scroll 2 from rotating during its orbiting movement. The frame 7 and the subframe 47 are coupled by press fitting their cylindrical engagement portions (socket and spigot joints), the cylindrical engagement portions being formed to provide coaxiality precision with the sleeve bearing 16 and the bearing 13 to locate the bearings 16 and 13 in alignment. The electric motor stator 9 is fastened to the subframe 47 by the bolts 37. The subframe 47 has the peripheral portion shrinkage fitted to the inner wall of the center shell 23. The center shell 23 is provided with the intake pipe 34, which opens into a space 48 in the shell. A space 49 which is partitioned by the subframe 47 in the shell is equalized to the space 48 in the shell by an equalizing groove in a peripheral portion of the subframe 47 in terms of pressure. The discharge pipe 43 opens to the discharge port 3, and the sealing terminals 38 are connected to the rotor 8 and the stator 9 through lead wires.

The operation of the conventional compressor of FIG. 14 will be explained. On energizing to the sealing terminals 38, torque is produced between the rotor 8 and the stator 9 to rotate the crankshaft 6. As a result, the orbiting scroll 2 starts rotating, and compresses the fluid gas in combination with the fixed scroll 1 in accordance with the well known compression principle. At that time, the fluid gas is inspired from outside through the intake pipe 34, and enters the spaces 48 and 49 in the shell. Then the fluid gas is inspired into the compression chamber 45 which is defined by the scrolls 1 and 2. After the inspired gas has been compressed, the gas is discharged outside from the discharge port 3 through the discharge pipe 43. In addition, when the crankshaft 6 rotates, a lubricating oil 33 is sucked by the centrifugal pumping action of the oil pump 36. The lubricating oil passes through an oil supply passage which is formed in the crankshaft 6. The oil which has passed through the oil supply passage is supplied to the bearings 13, 15, 16 and so on, and then returns into the shell 12 by gravity.

Referring to FIG. 19, there is shown a cross sectional view of another conventional scroll compressor which has been disclosed in Japanese Unexamined Patent Publication No. 116295/1989. Reference numeral 61 designates a frame which has a bearing 61a for the crankshaft 6. Reference numeral 62 designates a subframe which has a bearing 62a for the crankshaft 6. Reference numeral 63 designates a drain oil tube. The lubricating oil 33 is pumped up by the oil pump 36, passes through the passage in the crankshaft 6, lubricates sliding parts, and is discharged. The discharged oil passes through the drain oil tube 63, passes through an oil return hole 9a formed in the stator 9, and returns in the shell 12. In a hermetic housing which comprises a center shell 64, an upper shell 65 and a shell 12, the refrigerant gas is moved in a revolving flow by the rotating rotor 8. It requires that the route through which the lubricating oil 33 is flowing be isolated to be free from influence of the revolving flow. For the reason, the drain oil tube 63 and the oil return hole 9a are provided to prompt the lubricating oil 33 to return to the bottom in the hermetic housing. Other structure and operation are similar to those of the compressor of FIG. 14.

Since the conventional scroll type compressors are constructed as stated above, the discharge chamber 20, the fixed scroll 1, the frame 7 and the center shell 23 have to be fixed by use of many bolts, causing assemblage to be uneasy. In order to be airtight in the housing against the surrounding atmosphere, the contacting surfaces of the discharge chamber 20 and the fixed scroll 1, the contacting surfaces of the frame 7 and the center shell 23, and the contacting surfaces of the center shell 23 and the subframe 27 require strict flatness. The sealing member 42 has to be made of a refrigerant resistant and heat resistant material, making the compressor expensive. In addition, in order to assure coaxiality and perpendicularity between the bearing 13 of the frame 7 and the bearing 39 of the subframe 27, the socket and the spigot joints of the frame 7, the subframe 27 and the center shell 23 require strict machining accuracy. It is difficult that in order to meet the requirements, the center shell 23 is prepared in a thin walled form by a pipe shell process or a drawing shell process, without being prepared by machine cutting. It is also difficult that a glass terminal mounting portion is formed in the side surface of the center shell 23 by press working. Further, it is difficult to provide accuracy in roundness and so on of the center shell 23, which is the reason why a simple and inexpensive assemblage wherein the frame 7 is shrinkage fitted into the center shell 23 and the shrinkage fitted portions separate the hermetic housing into the high pressure space and the low pressure space can not be adopted.

In the conventional compressors, in order to support the thrust to the orbiting scroll 2, the sliding surfaces of the orbiting scroll 2 and the frame 7 require high accurate machining in the axial direction to be smooth and to prevent the compressed fluid from leaking in the axial direction. When even if the sliding surfaces are prepared to be smooth, the sliding surfaces can be seized as described in Japanese Unexamined Patent Publication No. 159780/1986, an expensive bearing material or an expensive plate has to be arranged between the sliding surfaces of the orbiting scroll 2 and the frame 7. Specifically, it is required that a plate 22 is arranged between the sliding surfaces of the orbiting scroll 2 and the frame 7, the plate 22 is mounted to the thrust surface of the orbiting scroll 2 by use of e.g. screws 24, and the frame 7 is provided with a bearing member as shown in FIG. 10. The arrangement of the conventional compressors wherein the thrust of the orbiting scroll 2 has to be supported requires high accurate work (super finishing grinding etc.) requires the provision of the bearing, and the mounting of the plate 22 to the thrust surface of the orbiting scroll 2 by use of the screws 24 etc. In the absence of the plate 22, the material hardness control of the orbiting scroll 2 must be also strict.

In the conventional scroll type compressor of FIG. 14, in order to press fit the subframe 47 into the center shell 23 in a sufficient manner, a shrinkage fit gap has to be sufficiently great, which creates problems in that the subframe 47 receives a shrinkage force in radial directions to elastically deform the frame 7 coupled with the subframe 47 in the form of socket and spigot joints, whereby the sliding surface of the thrust bearing 15 or the sleeve bearing 16 is deformed to deteriorate reliability in corresponding bearing, or in that the fixed scroll 1 which is fastened to the frame 7 by use of the bolts 46 has the spiral wrap 1*b* deformed due to distortion in the mounting surface to cause misalignment with respect to the orbiting scroll 2, thereby to be very noisy during operation, or to deteriorate performance due to leakage of the fluid. The arrangement wherein the internal spaces 48 and 49 work as intake spaces requires that a discharge muffler be arranged to damp a discharge pulse because the discharge gas from the discharge port 3 is exhausted directory outside through the discharge pipe 43. An idea wherein the internal space 49 is used as a discharge muffler involves a problem in that a differential pressure seal is required between the inner space 49 and the inner space 48, it is difficult to mount the sealing terminals 38 to the discharge chamber 20, the discharge chamber 20 or the center shell 23 is difficult to give roundness when the sealing terminals are mounted to the side surface, and the shrinkage gap of the subframe 47 becomes great to enlarge distortion due to deformation.

The conventional scroll type compressor of FIG. 19 requires that the drain oil tube 63 be inserted into the oil return hole 9*a* with an exact phase during assemblage. Due to the provision of a discharge muffler 66 at an upper portion in the hermetic housing, it is necessary to mount a glass terminal member 10 for supplying power to the electric motor to the cylindrical surface of a center shell, and also to preliminarily fit the stator 9 in the center shell 64 and connect the stator with the glass terminal member 10. These necessities prevent the compression unit and the stator 9 to be housed in the hermetic housing in such manner that phase determination is made at the same time. As a result, it is extremely difficult to carry out assemblage in such manner that mounting the drain oil tube 63 and mounting the oil return hole 9*a* are done in phase. If the diameter of the oil return hole 9*a* is expanded to enlarge clearance with respect to the drain oil tube 63, there is created a problem in that the lubricating oil leaks through the clearance, is mixed with the refrigerant gas, and is sucked into the compression chamber 45, causing the sucking amount of the oil to increase.

It is an object of the present invention to solve these problems, and to provide a scroll type compressor capable of fixing a compression unit to a center shell with a simple structure; of separating the inside of the center shell into a high pressure space and a low pressure space, and of receiving at a stepped portion of the center shell thrust which is caused by the differential pressure between the high pressure space and the low pressure space; and of mounting a frame and a subframe to the center shell with coaxiality and perpendicularity assured at their bearings without requiring high machining accuracy.

It is another object of the present invention to provide a scroll type compressor capable of preventing sliding surfaces of an orbiting scroll and a frame from being seized and of carrying out axial dimension control in an economical and easy manner.

It is another object of the present invention to provide a scroll type compressor capable of eliminating influence to parts by absorbing distortion which is caused at the time of shrinkage fitting an inner assembly to a center shell, of having a compact structure with a discharge muffler incorporated in it in a low cost.

It is another object of the present invention to provide a scroll type compressor capable of improving its assemblage.

According to a first aspect of the present invention, there is provided a scroll type compressor comprising a fixed scroll and an orbiting scroll which have their base plates provided with wraps thereon, the wraps being combined to form a compression chamber therebetween; a frame for fixedly supporting the fixed scroll, the frame having a bearing at a central portion; a crankshaft supported by the frame bearing to be rotatable, and having an electric motor rotor to give torque to the orbiting scroll; a subframe having a central portion provided with a bearing for supporting a lower end of the crankshaft; a center shell having a terminal member and an electric motor stator, having an inner peripheral surface formed with a stepped portion to be engaged with a stepped portion formed on an outer peripheral surface of the frame, the center shell having the frame fixed thereto by shrinkage fit at a location above or below the stepped portion of the center shell, and also having the subframe fixed to a lower end thereof; and concentric assemblage jig mounting portions formed in the frame and the subframe, respectively, to be concentric with the bearings.

According to a second aspect of the present invention, there is provided a scroll type compressor comprising a fixed scroll and an orbiting scroll which have their base plates provided with wraps thereon, the wraps being combined to form a compression chamber therebetween; a crankshaft having an electric motor rotor, for orbiting the orbiting scroll; a frame for rotatably supporting the crankshaft, having the orbiting scroll base plate supported on an upper surface thereof through a hard steel plate, and having a periphery provided with an annular portion whose height is substantially equal to the height of the orbiting scroll plus the thickness of the plate, the annular portion having the fixed scroll base plate mounted on an end surface thereof; a subframe for rotatably supporting a lower end of the crankshaft; and a center shell for fixedly supporting the electric motor stator, the frame and the subframe.

According to a third aspect of the present invention, there is provided a scroll type compressor comprising a fixed scroll and an orbiting scroll which have their base plates provided with wraps thereon, the wraps being combined to form a compression chamber therebetween; a crankshaft having an electric motor rotor, for orbiting the orbiting scroll; a frame for supporting the orbiting scroll, and rotatably supporting the crankshaft; a cylindrical spacer which is arranged between the fixed scroll base plate and the frame around the orbiting scroll, and which is coupled together with the fixed scroll and the frame; a center shell which is engaged with an electric motor stator and the spacer to fix the same; and a discharge chamber and a shell which cover the opposite ends of the center shell, the discharge chamber being provided with a discharge pipe.

According to a fourth aspect of the present invention, there is provided a scroll type compressor comprising a fixed scroll; an orbiting scroll; a compression unit fixed in a hermetic housing; a crankshaft having an electric motor rotor, and rotatably supported in the hermetic housing to give an orbiting movement to the orbiting scroll; an electric motor stator fixed in the hermetic housing to be engaged therewith; and an oil pump which is arranged in a lower end of the crankshaft, and which is immersed in a lubricating oil stored at a bottom portion in the hermetic housing; wherein the lubricating oil which is pumped by the oil pump is supplied to the compression unit through a passage in the crankshaft; the lubricating oil which is exhausted from the compression unit is returned to the bottom portion in the hermetic housing through a drain oil tube and an oil return hole in the electric motor stator; and the drain oil tube has at least a part made of flexible material.

In accordance with the first aspect, the stepped portion which is formed on the outer peripheral surface of the frame is engaged with and supported by the stepped portion which is formed on the inner peripheral surface of the center shell, and the center shell and the frame are shrinkage fitted each other at the location above or below the stepped portion of the center shell. In addition, the subframe can be fixed to the center shell by use of a concentric assemblage jig on the basis of the frame which has been shrinkage fitted to the center shell.

Such arrangement can use a simple structure to support by the center shell the frame which great thrust is applied to, and to hermetically hold a refrigerant gas whose pressure is different in spaces above and below the frame. In addition, the roundness of the center shell in the vicinity of the terminal member is unlikely to be adversely affected because the frame has the upper portion shrinkage fitted to the center shell with a circumferential surface machined. Further, the provision of the concentric assemblage jig mounting portions in the frame and the subframe can fix the frame and the subframe to the center shell having a pipe shape, maintaining coaxiality and perpendicularity between the bearings of the frame and the subframe.

In accordance with the second aspect, the hard steel plate is provided between the sliding surfaces of the orbiting scroll and the frame, the surface roughness between the sliding surfaces is minimized, and no grinding work is needed to facilitate axial dimension control.

The arrangement wherein the hard steel plate frame is provided between the sliding surfaces of the orbiting scroll and the frame to support thrust onto the orbiting scroll can minimize the surface roughness between the sliding surfaces, prevent the sliding surfaces of the orbiting scroll and the frame from being seized, and dispense with grinding work, thereby facilitating axial dimension control which is required to prevent a compressed fluid from leaking in the axial direction.

In accordance with the third aspect, the arrangement wherein the spacer is fixedly engaged with the center shell and fastened between the fixed scroll and the frame allows that even if the spacer is shrunk in a radial direction at the time of fixedly engaging the spacer with the center shell by e.g. shrinkage fit, distortion can be prevented in the fixed scroll or the frame by fastening the spacer to the fixed scroll and the frame after the engagement of the spacer with the center shell. If the discharge chamber is utilized as a discharge muffler space, the spacer can be used as a differential pressure seal.

The third aspect of the present invention has the arrangement wherein the spacer which has a concentric and cylindrical shape and controls the axial dimension between the scrolls is provided between the fixed scroll and the frame at an outer peripheral side of the orbiting scroll, and wherein the outer peripheral surface of the spacer and the inner peripheral surface of the center shell are fixed together in a close manner by e.g. shrinkage fit, and the fixed scroll and the frame are fixedly fastened to the spacer by e.g. a bolt. Such arrangement allows the spacer to absorb the distortion caused by the shrinkage fit to prevent the fixed scroll and the frame from being adversely affected by the distortion, thereby improving reliability in the bearings and performance and reducing noise. If the discharge chamber is utilized as a discharge muffler, the spacer can be used as a differential pressure seal to fabricate the compressor in a compact and simple structure.

In accordance with the fourth aspect, the drain oil tube is partly or in its entirety made of flexible material, and the flexible tube can be deformed to absorb the phase shift between the compression unit and the oil return hole.

The arrangement wherein the drain oil tube is partly or in its entirety made of flexible material allows that the flexible tube is deformed to absorb the phase shift between the compression unit and the oil return hole in the electric motor stator, thereby facilitating assemblage. In addition, the gap between the flexible tube and the oil return hole in a radial direction can be minimized to decrease the leakage of the oil through the gap, lowering the sucking amount of the oil to the compressor.

In drawing:

FIG. 1 is a longitudinal sectional view of the scroll type compressor according to a first embodiment of the present invention;

FIGS. 2(*a*) and 2(*b*) are longitudinal sectional views of parts fixed by shrinkage fit in the first embodiment;

Figure 6:
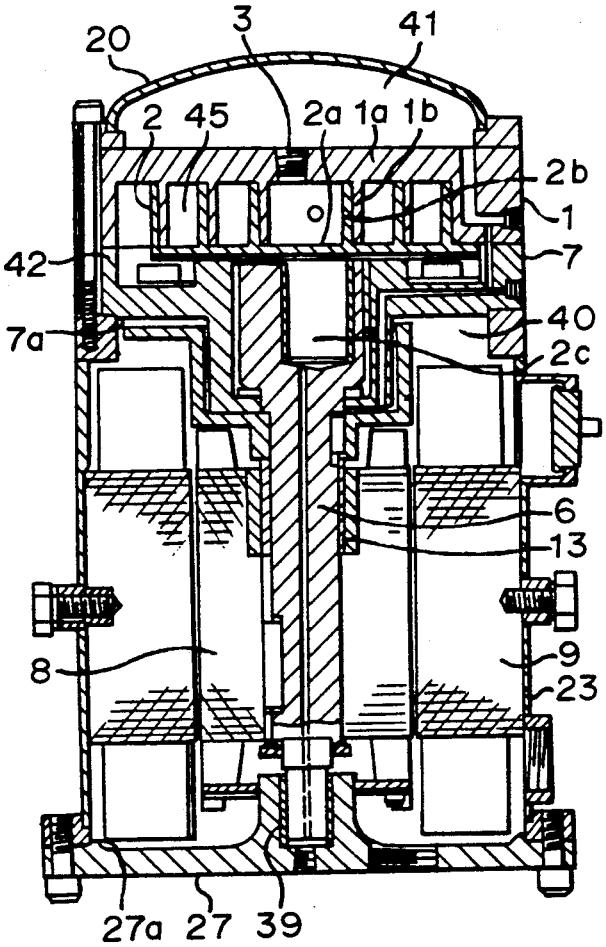
FIGURE 6 PRIOR ART
Figure 7:
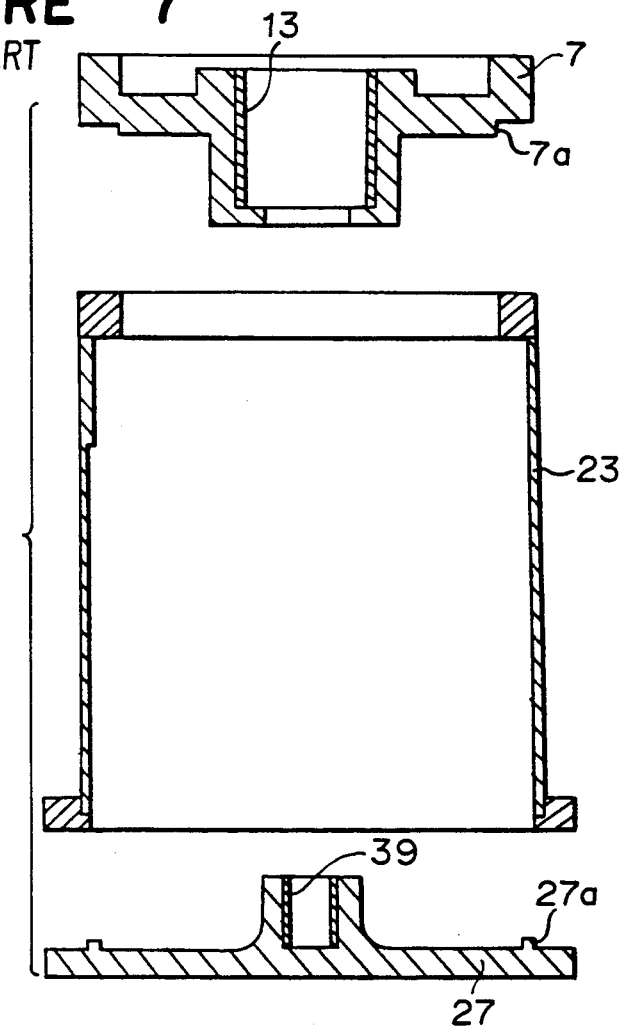
FIGURE 7 PRIOR ART
Figure 8:
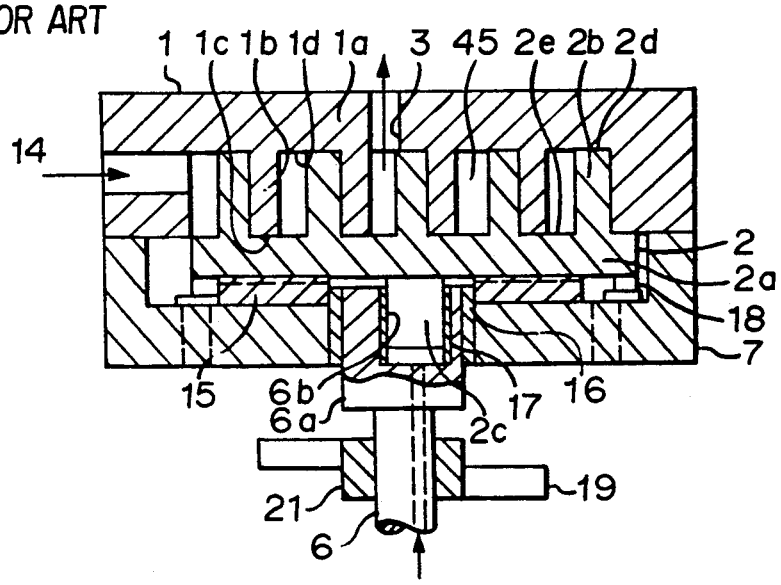
FIGURE 8 PRIOR ART
Figure 9:
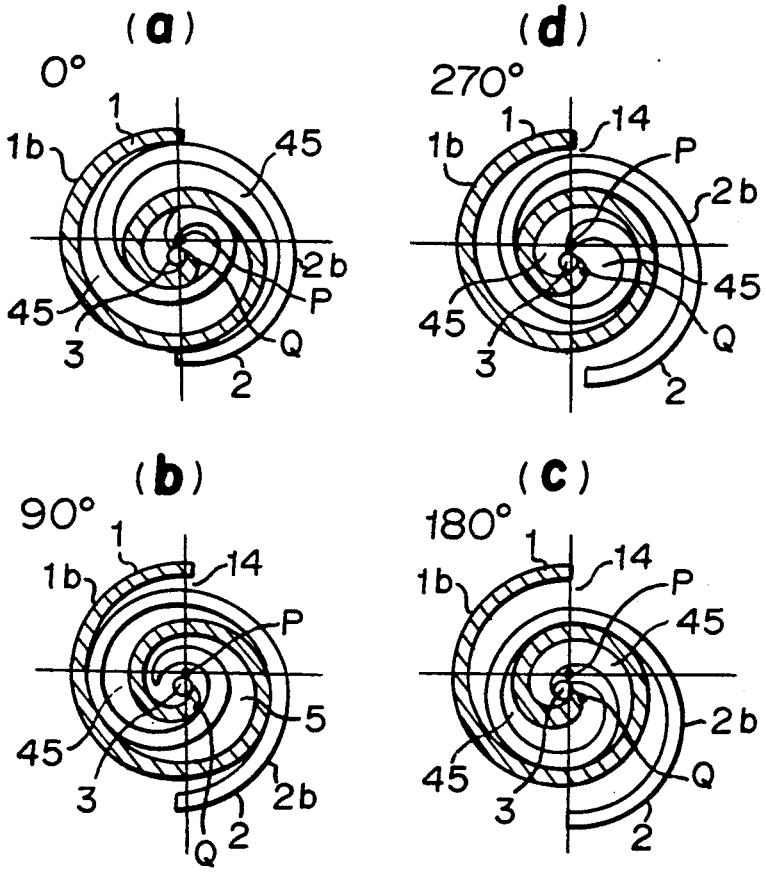
Figure 10:
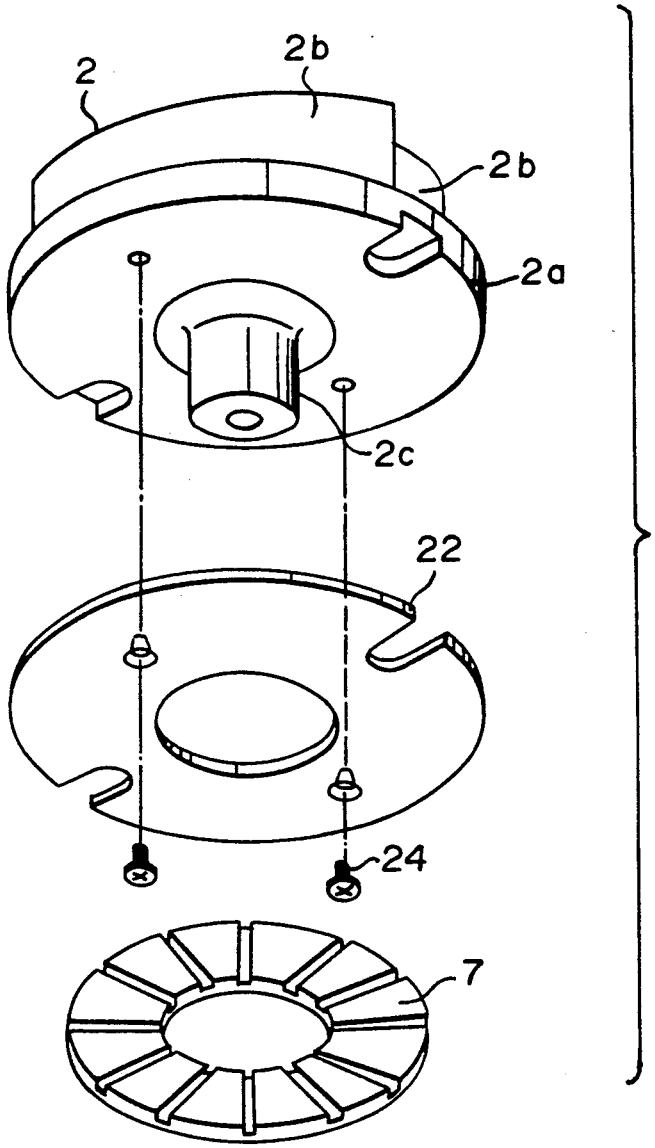
FIGURE 10 PRIOR ART
Figure 11:
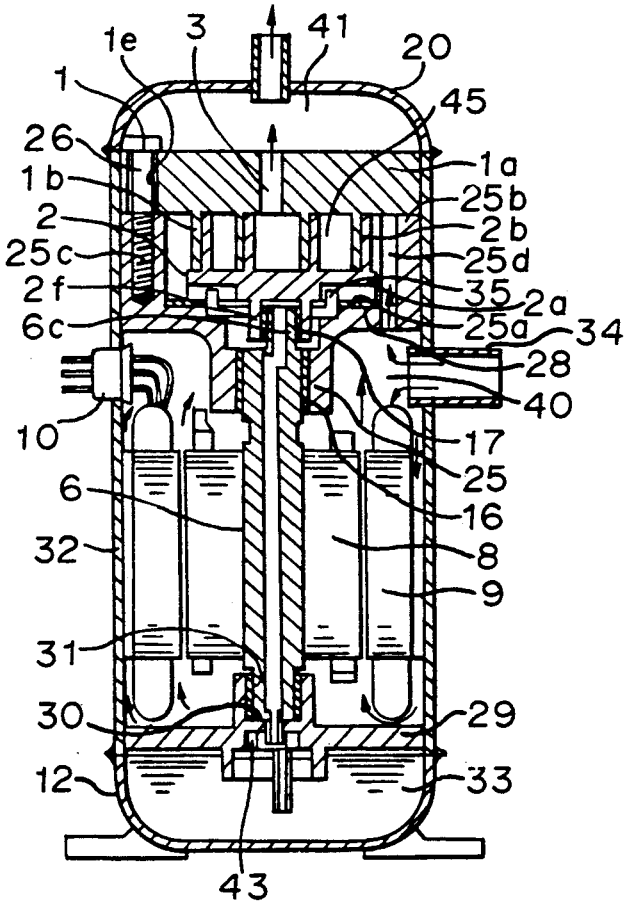
Figure 12:
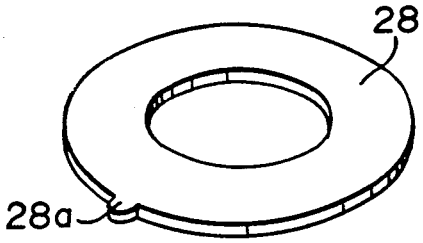
Figure 13:
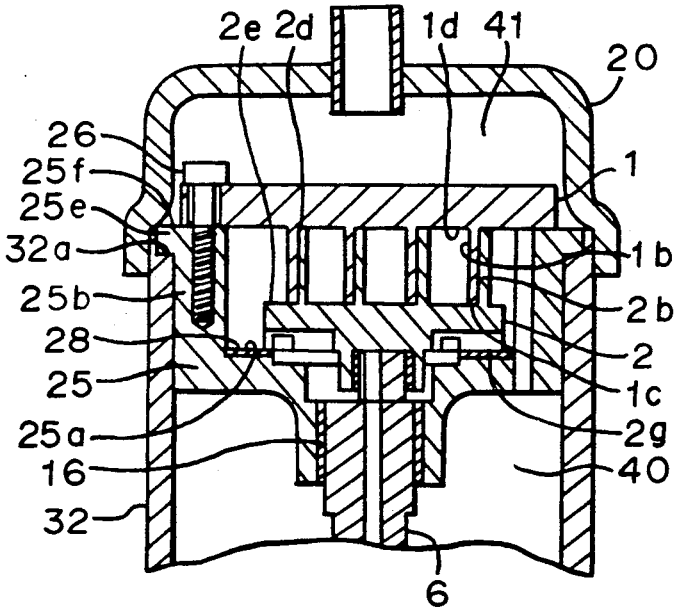
Figure 14:
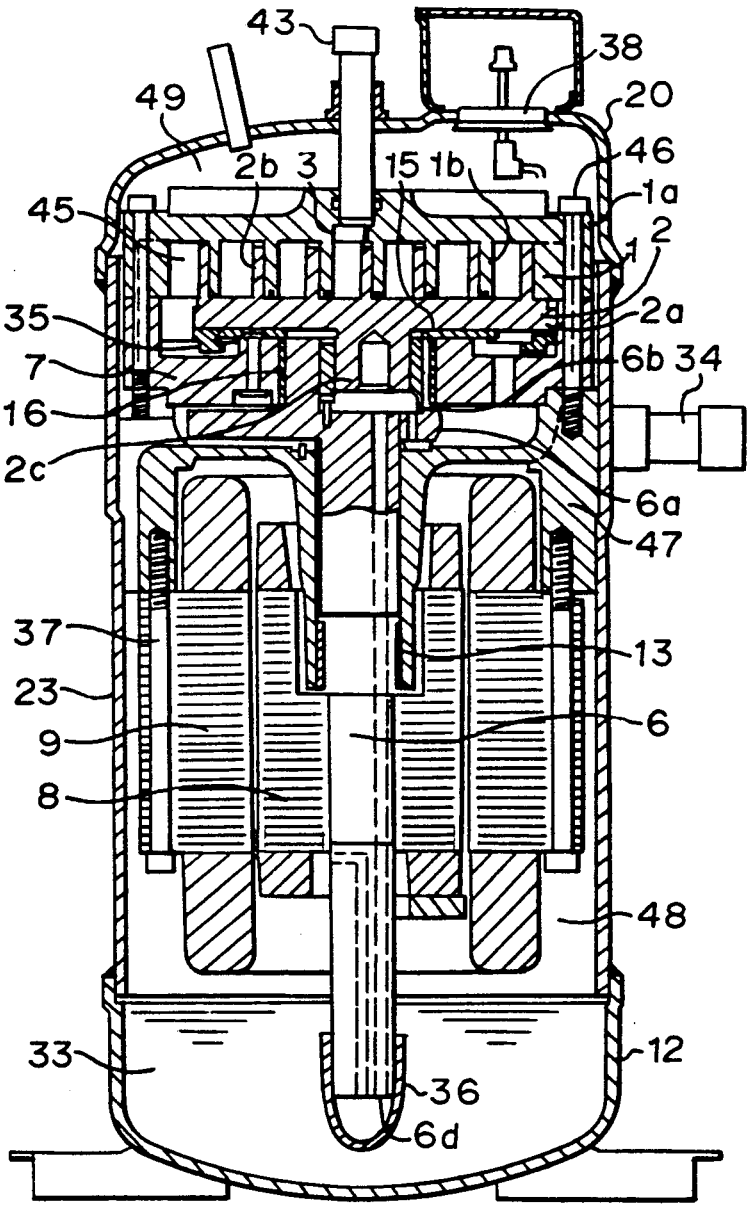
FIGURE 14 PRIOR ART
Figure 15:
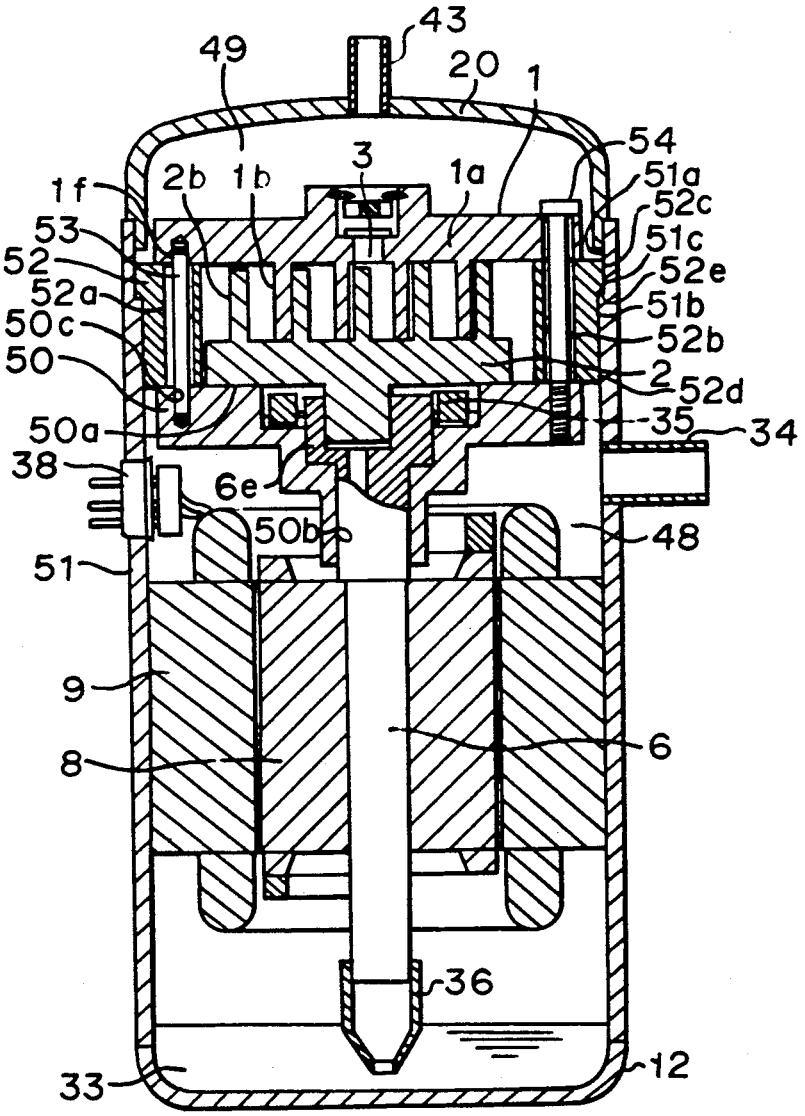
Figure 16:
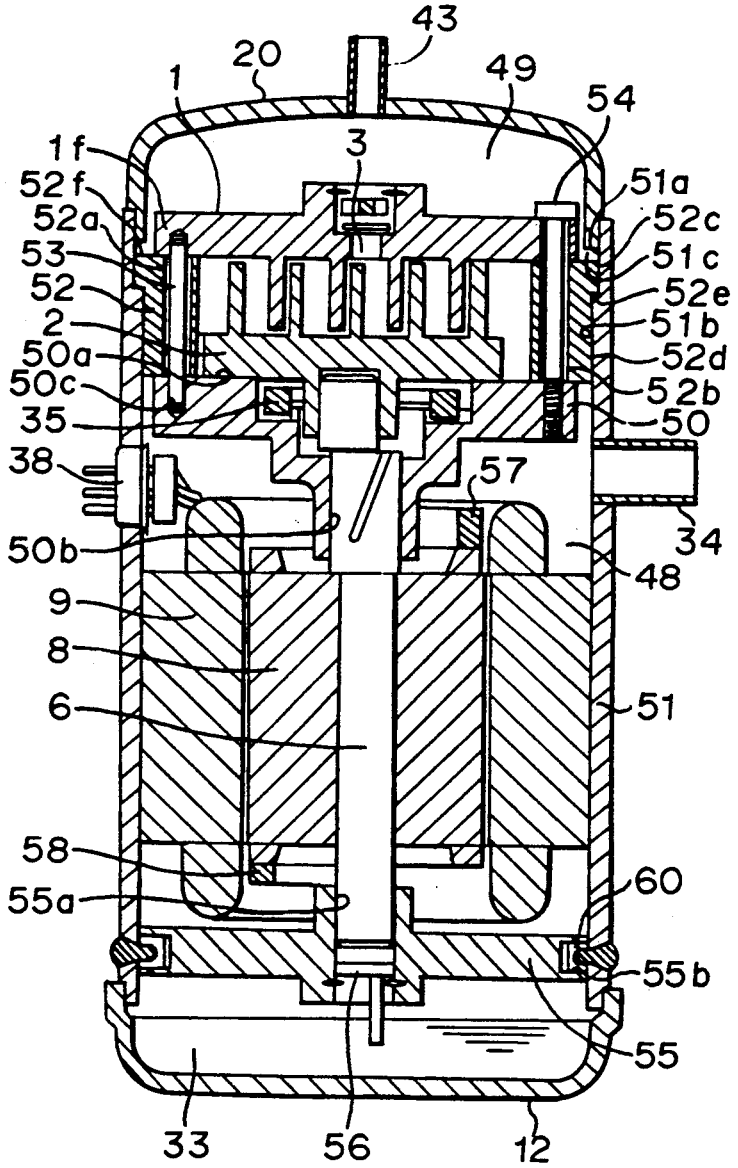
Figure 17:
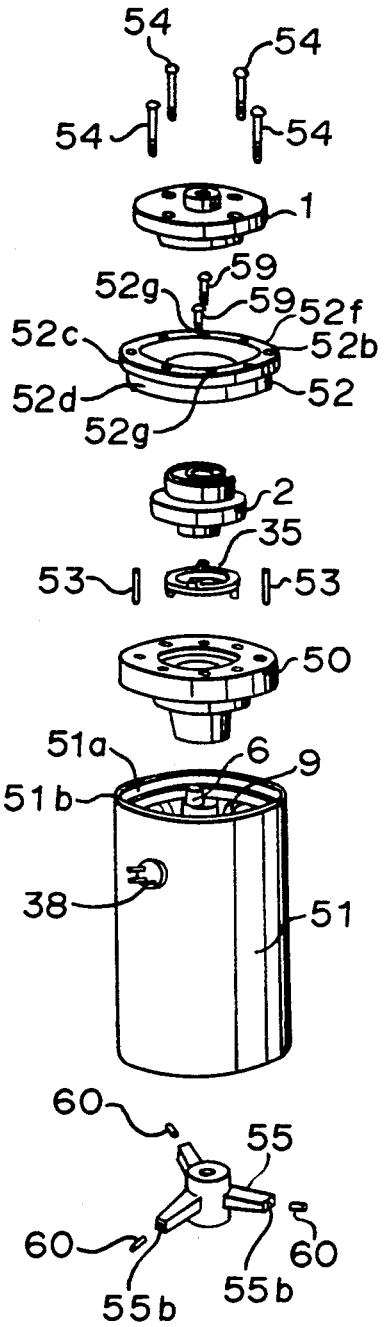
Figure 18:
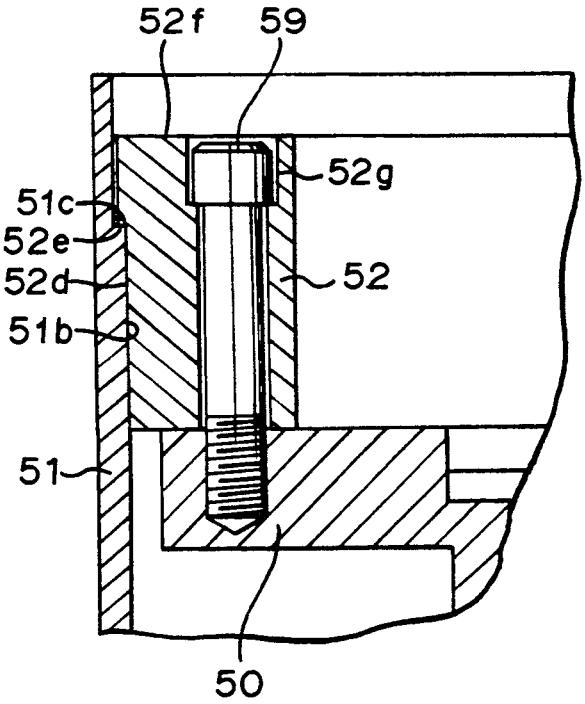
Figure 19:
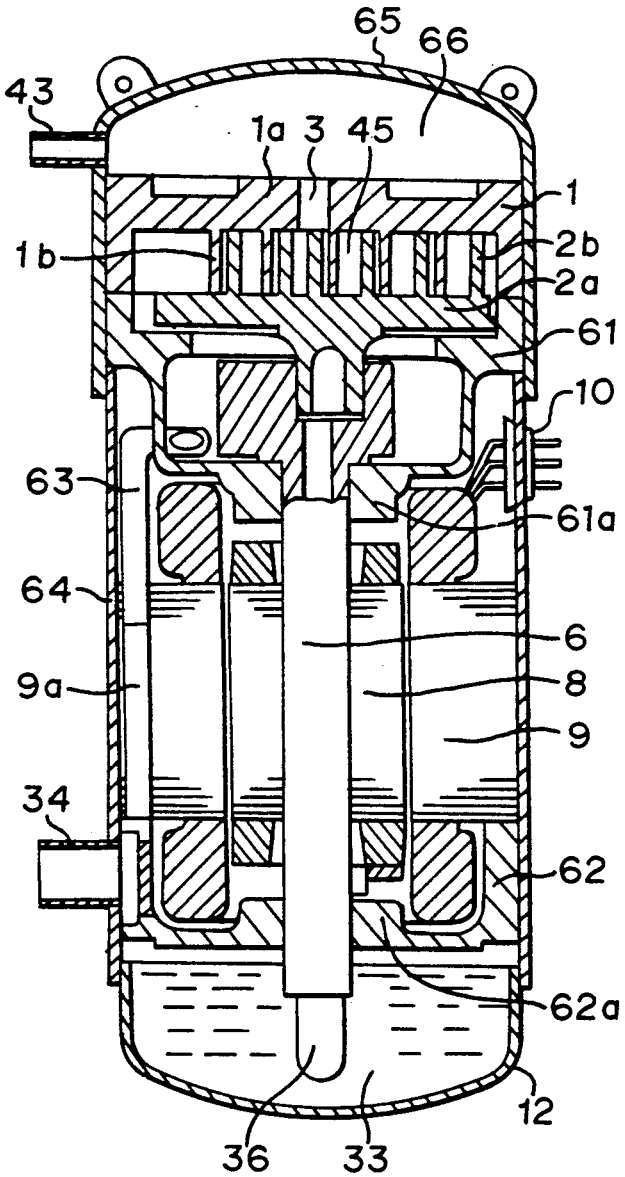
FIGURE 19 PRIOR ART
Figure 20:
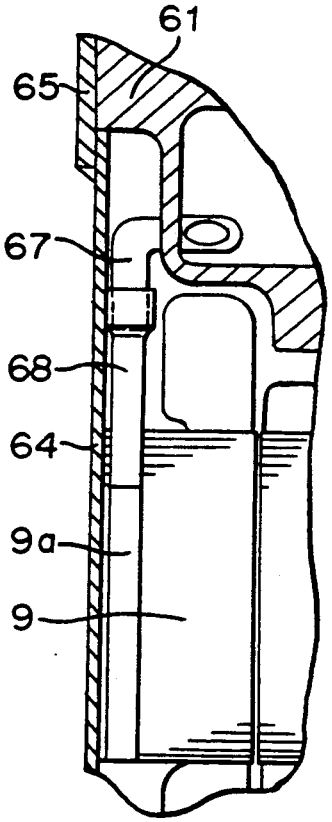

FIGS. 5(*b*) and 5(*c*) are a longitudinal sectional view and a plane view of a pump casing in the first embodiment;

FIGS. 5(*d*) and 5(*e*) are a longitudinal sectional view and a plane view of a positive displacement pump;

FIGS. 5(*f*) and 5(*g*) are a longitudinal sectional view and a plane view of a pump port;

FIGS. 6 and 7 are a longitudinal sectional view of a conventional scroll type compressor and an exploded sectional view of socket and spigot joints in the conventional compressor, respectively;

FIG. 8 is a longitudinal sectional view of the essential parts of the conventional scroll type compressor;

FIGS. 9(*a*)–9(*d*) are diagrams to help explain the compression principle of the scroll type compressor;

FIG. 10 is an exploded perspective view of a thrust supporting mechanism for an orbiting scroll in the conventional scroll type compressor;

FIG. 11 is a longitudinal sectional view of the scroll type compressor according to a second embodiment of the present invention;

FIG. 12 is a perspective view of a plate in the second embodiment;

FIG. 13 is an enlarged longitudinal sectional view of the essential parts of the scroll type compressor of the second embodiment;

FIG. 14 is a longitudinal sectional view of a conventional scroll type compressor;

FIG. 15 is a longitudinal sectional view of the scroll type compressor according to a third embodiment of the present invention;

FIG. 16 is a longitudinal sectional view of the scroll type compressor according to a forth embodiment of the present invention;

FIG. 17 is an exploded perspective view of the essential parts in the forth embodiment;

FIG. 18 is a longitudinal sectional view of the essential parts in the fourth embodiment;

FIG. 19 is a longitudinal sectional view of a conventional scroll type compressor; and FIG. 20 is an enlarged partially sectional view of the scroll type compressor according to a fifth embodiment of the present invention.

Preferred embodiments of the present invention will be described with reference to the drawings.

Referring to FIGS. 1-5(*g*), there is shown the scroll type compressor according to a first embodiment of the present invention. In these Figures, reference numeral 4 designates a frame which has a collar 4*a*, and which fixedly arranges a base plate 1*a* of a fixed scroll 1 on an upper end surface of the collar 4*a*. The collar 4*a* has an outer peripheral surface formed with a stepped portion 4*b*, and an inner peripheral surface formed to provide a concentric assemblage jig mounting surface 4*c* which is concentric with a bearing 13 which is integral with the frame 4 at its central portion. Reference numeral 5 designates a center shell which has an intermediate portion provided with a glass terminal member 10, and which supports an electric motor stator 9. The center shell has an inner top peripheral surface formed with a stepped portion 5*a* to be engaged with the stepped portion 4*b* of the frame 4. Reference numeral 11 designates a subframe which is fixed to a lower end of the center shell 5, and which has a central portion formed integrally with a bearing 39 for supporting a lower end portion of a crankshaft 6. Below the bearing 39 is provided a concentric assemblage jig mounting surface 11*a* which is concentric with the bearing 39. A pump unit 43 is housed in the concentric assemblage jig mounting surface. Reference numeral 20 designates a discharge chamber which is mounted to an upper end of the center shell 5. Reference numeral 44 designates a welding piece. Reference numerals 44*a* and 44*b* designate concentric assemblage jigs. Reference numeral 12 designates a shell which is sealingly mounted to a lower end of the center shell 5.

In operation, the electric motor stator 9 supported by the intermediate portion of the center shell 5 and an electric motor rotor 8 fixed on the intermediate portion of the crankshaft 6 drives the crankshaft 6. While the crankshaft 6 is being supported by the bearing 13 of the frame 4 and the bearing 39 of the subframe 11, the crankshaft 6 causes an orbiting scroll 2 to make orbiting movement, thereby forming a compression chamber 45 between the fixed scroll 1 and the orbiting scroll 2. A low pressure refrigerant gas which is in a low pressure space 40 is inspired into the compression chamber 45 by the compression action of the fixed scroll 1 and the orbiting scroll 2, is compressed into a high pressure refrigerant gas, and then is discharged into a high pressure space 41 through a discharge port 3.

Figure 1:
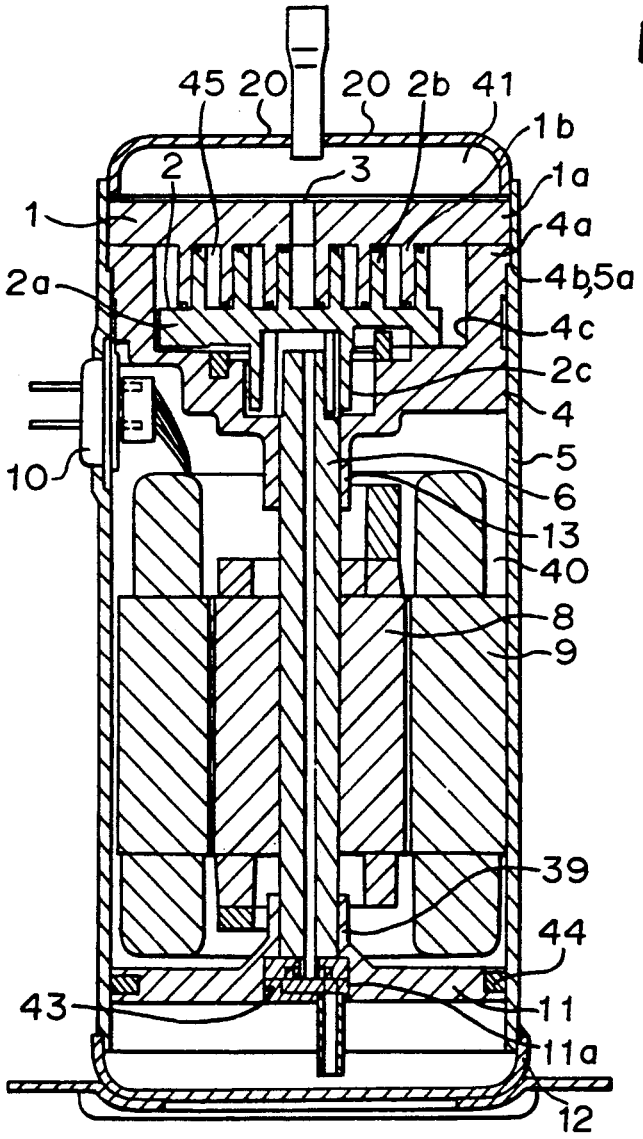
Figure 2:
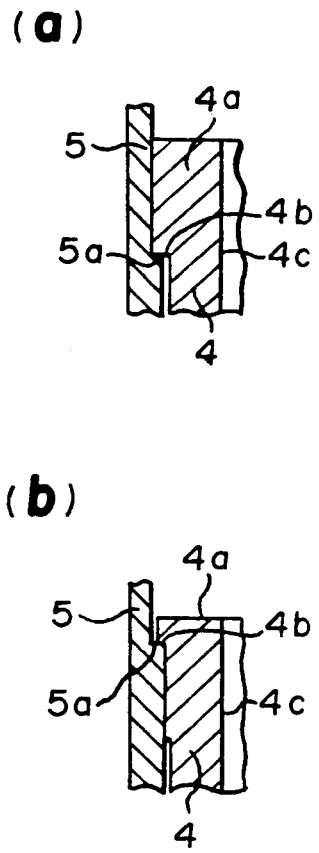

As shown in FIGS. 2(*a*) and 2(*b*), the stepped portion 5*a* which is formed on the inner top peripheral surface of the center shell 5 by machining supports the stepped portion 4*b* which is formed on the outer peripheral surface of the collar 4*a* of the frame 4. Such arrangement receives thrust which is caused by a pressure difference between the high pressure space 41 and the low pressure space 40, thereby to prevent the frame 4 from shifting in the axial direction in the center shell 5. The outer peripheral surface of the collar 4*a* and the inner peripheral surface of the center shell 5 are shrinkage fitted for fixing at a location above or below of the stepped portions 4*b* and 5*a* of the frame 4 and the center shell 5 to hermetically separate the high pressure space 41 and the low pressure space 40. Because the shrinkage fitted portion on the inner peripheral surface of the center shell 5 is formed by machining at that time, distortion in the inner peripheral surface of the center shell 5 which is caused when a mounting portion for the glass terminal member 10 is formed in the center shell 5 by press working can be absorbed. As a result, gastightness can be obtained at the shrinkage fitted portions at a high level, coaxiality between the inner diameter of the bearing 13 of the frame 4 and the inner diameter of the electric motor stator 9 is ensured, and an air gap between the electric motor stator 9 and the electric motor rotor 8 is equalized. In FIG. 2(*a*), there is shown a case wherein shrinkage fit is made above the stepped portions 4*b* and 5*a*. In FIG. 2(*b*), there is shown a case wherein shrinkage fit is made below the stepped portions 4*a* and 5*a*.

Figure 3:
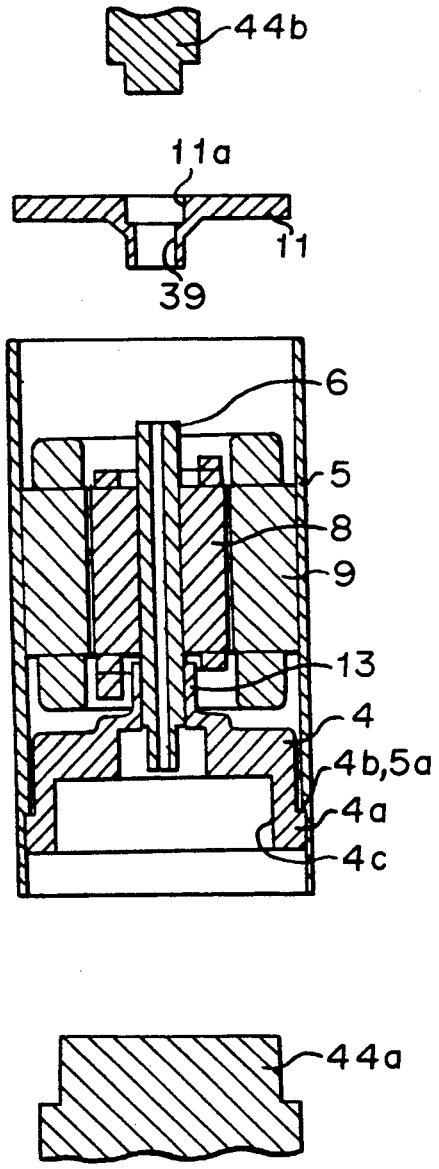
FIGS. 3 and 4 are longitudinal sectional views showing how to mount a frame and a subframe to a center shell by use of concentric assemblage jigs in the first embodiment.
Figure 4:
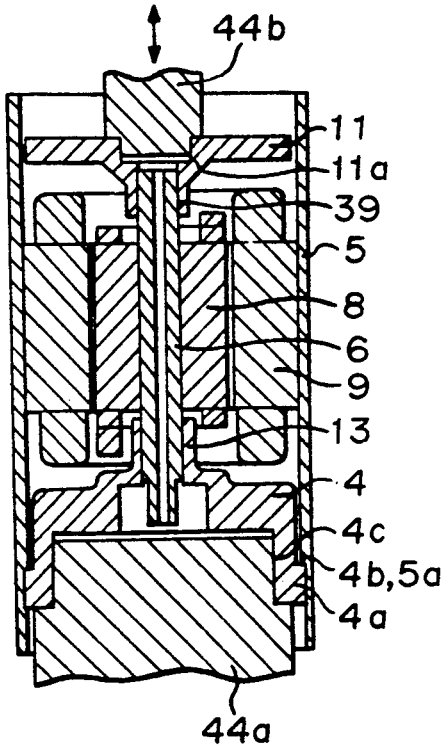
Figure 5A:
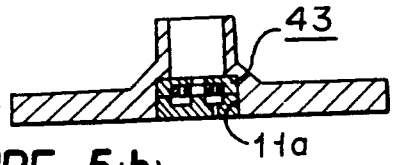
FIG. 5(*a*) is a longitudinal sectional view showing how to house a pump unit in the subframe.
Figure 5B:
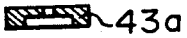
Figure 5C:
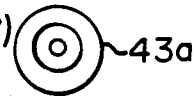
Figure 5D:
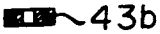
Figure 5E:
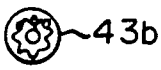
Figure 5F:
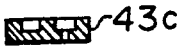
Figure 5G:
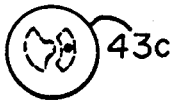

As shown in FIG. 3, the coaxiality and the perpendicularity with respect to the bearing 13 is given, with predetermined precision, to the concentric assemblage jig mounting surface 4*c* on the inner peripheral surface of the collar 4*a* of the frame 4, the coaxiality and the perpendicularity with respect to the bearing 39 is given, with predetermined precision, to the concentric assemblage jig mounting surface 11*a* of the subframe 11, and the concentric assemblage jigs 44*a* and 44*b* which have coaxiality and perpendicularity given with predetermined precision are used. As shown in FIG. 4, the frame 4 is shrinkage fitted to the center shell 5 which has the electric motor stator 9 fixed thereto, the concentric assemblage jig 44*a* such as a collet chuck is attached to the concentric assemblage jig mounting surface 4*c* of the frame 4, the concentric assemblage jig 44*b* such as a collet chuck is attached to the concentric assemblage jig mounting surface 11*a* of the subframe 11, and the subframe 11 is fixed to the center shell 5 by welding on the basis of the frame 4. By doing so, the subframe 11 can be fixed to the center shell 5 while the coaxiality and the perpendicularity between the bearing 13 of the frame 4 and the bearing 39 of the subframe 11 can be obtained with predetermined precision. The welding piece 44 which is movable in a radial direction can be press fitted in a welded portion of the subframe 11 by a press fit load which is smaller than a shrinkage force caused during welding. This arrangement allows that the welding piece 44 moves during welding to absorb distortion caused during welding.

As shown in FIG. 5(*a*), the pump unit 43 is housed the concentric assemblage jig mounting surface 11*a* of the subframe 11. The pump unit 43 is constituted by a pump casing 43*a* shown in FIGS. 5(*b*) and 5(*c*), a positive displacement pump 43*b* shown in FIGS. 5(*d*) and 5(*e*), and a pump port member 43*c* with an intake port and a discharge port formed therein shown in FIGS. 5(*f*) and 5(*g*).

Referring now to FIGS. 11 through 13, there is shown the scroll type compressor according to a second embodiment of the present invention. A fixed scroll 1 has a base plate la formed with a bolt hole le for inserting a bolt 26, which is used to connect the fixed scroll 1 and a frame 25. An orbiting scroll 2 has a base plate 2*a* provided with a boss 2*f* at the side remote from a spiral wrap 2*b*, the boss 2*f* being engaged with an eccentric axial portion 6*c* on the top end of a crankshaft 6 through e.g. an orbiting bearing 17. Reference numeral 2*g* designates a lower surface of the orbiting scroll 2. The frame 25 has a plate 28 put on an upper surface 25*a* to support thrust applied to the orbiting scroll 2. The frame 25 has an outer peripheral portion 25*b* which is formed an annular shape to connect with the base plate 1*a* of the fixed scroll 1, and which has a screwed hole 25*c* formed therein to allow the bolt 26 to be screwed. The distance between a contacting surface 25*f* of the frame 25 to the base plate 1*a* (see FIG. 13) and the upper surface 25*a* is substantially equal to a value which is obtained by adding the height of the spiral wrap 2*b*, the thickness of the base plate 2*a* and the thickness of the plate 28. As shown in FIG. 12, the plate 28 is provided with a projection 28*a* for preventing rotation of the plate 28 so that the orbiting movement of the orbiting scroll 2 caused by the rotation of the crankshaft 6 is prevented from rotating the plate 28. The frame 25 has the outer peripheral portion 25*b* formed with a notch (not shown), and a combination of the notch and the projection 28 prevents rotation of the plate 28. The thickness of the plate 28 is equalized by rolling work. A subframe 29 is provided with a small thrust bearing 30 for supporting thrust to the crank shaft 6 and an electric motor rotor 8, and a small sleeve bearing 31 for supporting rotation of the crankshaft 6. Reference numeral 32 designates a center shell which has a glass terminal member 10 in connection with a driving source for giving a driving force to the rotor 8 and an electric motor stator 9. The center shell supports the frame 25 and the subframe 29 by welding, press fit, shrinkage fit or the like, and supports the stator 9 by shrinkage fit. Reference numeral 33 designates a lubricating oil which is stored in a shell 12. Reference numeral 35 designates an Oldham's coupling. Part of a low pressure fluid which has entered through an intake pipe 34 is directed to a compression chamber 45 through a passage 25*d* in the frame 25 as indicated by arrows. A discharge chamber 20, the center shell 32 and the shell 12 are connected together by welding to form a hermetic housing.

Assemblage of the scroll type compressor shown in FIGS. 11 through 13 will be explained. Firstly, the stator 9 is fixed to the center shell 32 by shrinkage fit. The center shell 32 is prepared to have roundness and cylindricity with respect to the center of the stator 9 with good precision so that the centers of the rotor 8 and the stator 9 in their axial directions correspond with each other. Secondly, the crankshaft 6 which the rotor 8 has been fixed to by shrinkage fit is inserted into and supported by a sleeve bearing 16 and the small sleeve bearing 31. The frame 25 and the subframe 29 are fixed to the center shell 32 by shrinkage fit, press fit, welding or the like with good precision so that the center of the crankshaft 6 corresponds with the centers of the bearings 16 and 31. The center shell 32 is prepared with good precision so that the center of the rotor 8 corresponds with that of the stator 9. The frame 25 is provided with an annular projection 25*e*, which is in contact with an end surface 32*a* of the center shell 32 to support the frame 25 in the axial direction. The frame 25, the subframe 29, the rotor 8, the stator 9 and the crankshaft 6 are installed into the center shell 32 in that manner. After that, the fixed scroll 1 and the frame 25 are fastened by the bolt 26 while the frame 25 has the plate 28 put on the upper surface 25*a*, and the spiral wraps 1*b* and 2*b* are opposed each other. Lastly, the discharge chamber 20 and the shell 12 are welded to the center shell 32. In that manner, a higher pressure space 41 and a low pressure space 40 are separated.

Now, the function of the plate 28 will be explained. Where the surface roughness of the sliding surface of the orbiting scroll 2 is $R_0$, that of the sliding surface of the frame 25 is $R_f$ and that of the sliding surface of the plate 28 is $R_p$, each surface roughness is as follows depending on working when metal such as iron and aluminum is used as material:

| | |
|---|---|
| $R_0$ = | 3.2–6.3 Z (cutting work by e.g. a lathe) |
| = | 0.8–1.6 Z (grinding work by a grinder) |
| $R_f$ = | 3.2–6.3 Z (cutting work by e.g. a lathe) |
| = | 0.8–1.6 Z (grinding work by a grinder) |
| = | 0.8–1.6 Z (at the time when a thrust bearing is used) |
| $R_p$ = | 0.5 Z or less |

By the way, in order to prevent the compressed fluid from leaking in the axial direction, the surfaces 1*c*, 1*d*, 2*d*, 2*e*, 2*g*, 25*a* and 25*f* which are necessary for axial dimension control have to be prepared with high precision. Consideration of it, it is general that e.g. the surfaces 2*g*, 25*a* and 25*f* are subjected to cutting work. However, it is required that the frame 25 be prepared so that the distance between the upper surface 25*a* and the contacting surface 25*f* is substantially equal to the value which is obtained by adding the height of the spiral wrap 2*b*, the thickness of the base plate 2*a* and the thickness of the plate 28. Due to such requirement, it is difficult to prepare the upper surface 25*a* by grinding work, and the upper surface 25*a* is forced to be prepared by cutting work. In addition, it is required that the high pressure space 41 and the low pressure space 40 have to be separated while the axial centers of the sleeve bearing 16 and the small sleeve bearing 31 correspond with the axial center of the crankshaft 6. For this reason, the axial support and such separation are made by abutting the projection 25*e* of the frame 25 against the end surface 32*a* of the center shell 32. The use of a thrust bearing is generally expensive in comparison with the plate 28 which is made of a hard steel plate and which is inexpensive. For these reasons, the following inequality is obtained:

$$R_0+R_p<R_O+R_f$$

The provision of the plate 28 can realize a scroll type compressor which is inexpensive, which is free from seizing and has high reliability, and which is easy in axial dimension control.

Referring now to FIG. 15, there is shown the scroll type compressor according to a third embodiment of the present invention. Reference numeral 50 designates a frame. Reference numeral 51 designates a center shell. Reference numeral 52 designates a cylindrical spacer. Reference numeral 1*f* designates a set pin hole. Reference numeral 50*a* designates a thrust bearing portion which is formed on top of the frame 50. Reference numeral 6*e* designates a sleeve bearing which is formed in an upper portion of a crankshaft 6. Reference numeral 50*b* designates a bearing for the crankshaft 6, which is formed in the frame 50. Reference numeral 50*c* designates a set pin hole which is formed in the frame 50. Reference numeral 51*a* designates a large inner diameter portion of the center shell 51. Reference numeral 51*b* designates a small inner diameter portion of the center shell 51. Reference numeral 51*c* designates a stepped portion which is formed on an inner peripheral surface of the center shell 51. Reference numeral 52*a* designates a set pin hole which is formed in the spacer 52. Reference numeral 52*b* designates a bolt hole which is formed in the spacer 52. Reference numeral 52*c* designates a large outer diameter portion of the spacer 52. Reference numeral 52*d* designates a small inner diameter portion of the spacer 52. Reference numeral 52*e* designates a stepped portion which is formed in an outer peripheral surface of the spacer 52. Reference numeral 53 designates a set pin which passes through the spacer 52 to fasten a fixed scroll 1 and the frame 50. Reference numeral 54 designates a bolt which passes through the spacer 52 to fasten the fixed scroll 1 and the frame 50. Assemblage of such structure is as follows: Firstly, an electric motor stator 9 is fixed to the center shell 51 by shrinkage fit, and is connected to a sealed terminal member 38. Secondly, the spacer 52 is fixed to the inner wall of the center shell 51 by shrinkage fit. During shrinkage fit, the frame 50 is temporarily fixed to the spacer 52 by e.g. a screw, while the crankshaft 6 which an electric motor rotor 8 has been fixed to by shrinkage fit is mounted to the frame 50. The spacer 52 has the outer peripheral surface provided with the large outer diameter portion 52*c*, the small outer diameter portion 52*d* and the stepped portion 52*e*, and the center shell 51 has the upper end portion provided with the large inner diameter portion 51*a*, the small inner diameter portion 51*b* and the stepped portion 51*c*. The outer diameter portions 52*c* and 52*d* are press fitted into the inner diameter portions 51*a* and 51*b* by e.g. shrinkage fit, and the stepped portions 52*e* and 51*c* are engaged with each other to restrict axial movement. When shrinkage fit is made at the large diameter portions 52*c* and 51*a*, the large inner diameter portion 51*a* of the center shell 51 is machined by cutting because the inner diameter of the center shell 51 does not have roundness due to influence of the welding fixing of the sealed terminal member 38 and a discharge pipe 34. Machining the large inner diameter 51*a* by cutting facilitates shrinkage fit gap control. After the spacer 52 has been fixed to the center shell 51 by shrinkage fit, the temporarily fixed screw is tightened while maintaining the frame 50 and the stator 9 in alignment. After engagement of an Oldham's coupling 35 and an orbiting scroll 2, the fixed scroll 1 is fastened to the spacer 52 so that the fixed scroll 1 has a spiral wrap 1*b* combined with a spiral wrap 2*b* of the orbiting scroll 2. For such assemblage, the set pin 53 is used to locate the fixed scroll 1 and the frame 50 in alignment. The set pin hole 1*f* in the fixed scroll 1 and the set pin hole 50*c* in the frame 50 are located in alignment with good precision to minimize the fitting gap between the set pin 53 and the holes, and the set pin hole 52*a* in the spacer 52 has the inner diameter formed to provide great play to the outer diameter of the set pin 53. Even if a change in dimension is caused due to shrinkage in a radial direction during shrinkage fit of the spacer 52 into the center shell 51, dimension precision can be adjusted by making the play greater than the shrinkage. After the fixed scroll 1 and the frame 50 have been located in alignment in that manner, the bolt 54 is tightened to fasten the fix scroll 1 to the frame 50 through the spacer 52. The thickness of the spacer 52 is determined to have such dimension that the axial gap between the spiral wraps 1*b* and 2*b* of the fixed scroll 1 and the orbiting scroll 2 becomes optimum.

The scroll type compressor fabricated in that manner has the inside divided into internal spaces 48 and 49 by the shrinkage fitted portions 51*a* and 52*c* or 51*b* and 52*d*, the intake pipe 34 opens into the internal space 48 to form an intake space, and a discharge port 3 opens into the internal space 49 to form a discharge space, thereby allowing a discharge gas to be exhausted outside through a discharge pipe 43. The internal space 49 is large enough to function as a discharge muffler. There is a difference between the intake pressure in the internal space 48 and the discharge pressure in the internal space 49 as mentioned above. The seal for such pressure difference is provided by the shrinkage fitted portions 51*a* and 52*c* or 51*b* and 52*d*. The thrust, which is applied toward the internal space 48 due to the differential pressure, is supported by the engagement of the stepped portions 51*c* and 52*e*.

In accordance with the third embodiment, deformation due to the shrinkage fit can be absorbed by the space 52, and a discharge muffler function can be given to the internal space 49 above the fixed scroll 1 to make the structure of the compressor compact in an easy manner without using a special sealing member.

In compressors for air conditioning, variable speed operation by use of inverter control has been recently dominant. Such operation involves problems in that during a low speed operation, oil feed to sliding parts must be insured in a sufficient amount, and that during a high speed operation, a centrifugal force is increased to cause elastic deformation in the crankshaft 6. A fourth embodiment which can solve these problems is shown in FIGS. 16 through 18. In the fourth embodiment, a frame 50 and a subframe 55 are arranged above and below an electric motor 8, 9, and the frame 50 and the subframe 55 have a crankshaft 6 supported by their bearings 50*b* and 55*a*. To a lowered end portion of the crankshaft 6 is directory coupled to a positive displacement pump 56 such as trochoid pump. By such structure, the positive displacement pump 56 can ensure the oil feed in at least the minimum amount even during the low speed operation, and that the elastic deformation in the crankshaft 6 by the increased centrifugal forces which are applied to balancers 57 and 58 for balancing with an orbiting scroll 2 during the high speed operation is minimized by supporting the opposite ends of the crankshaft 6 by use of the bearings 50*b* and 55*a*. The coaxiality between the frame 50 and the subframe 55 is important, and the coaxiality of the stator 9 should be insured because the stator 9 is fastened to center shell 51 by shrinkage fit. The assemblage of the fourth embodiment is similar to that of the third embodiment until the shrinkage fit of a spacer 52 to the center shell 51. Explanation of bolts 59 for temporary fixing, which has been omitted with respect to the third embodiment, will be explained, referring to FIGS. 17 and 18. Before the spacer 52 is fastened to the center shell 51 by shrinkage fit, the spacer 52 has to be temporarily fastened to the frame 50. In order to prevent the heads of the bolts 59 from projecting from a mounting surface 52*f* of the spacer 52 to a fixed scroll 1 when the spacer 52 has been temporarily fastened to the frame 50 by the bolts 59, the mounting surface 52*f* of the spacer 52 has counterbores 52*g* formed therein. After the spacer 52 has been fixed to the center shell 51 by shrinkage fit, the bolts 59 are permanently tightened while carrying out such control that the stator 9 which has been fixed to the center shell 51 in advance, and the frame 50 are located in alignment. The distortion which is caused by fixing the spacer 52 to the center shell 51 by shrinkage fit can be absorbed by a relative slip with the frame 50, and the coaxiality between the frame 50 and the stator 9 can be ensured by the spacer 52 and the center shell 51. Next, in order that the subframe 55 is fixed to the center shell 51 to align the subframe 55 with the frame 50 to provide coaxiality, the subframe 55 is moved in the center shell 51 while having a radial gap between the subframe 55 and the center shell 51, and is fixed at such location that the coaxiality between the subframe 55 and the frame 50 can be provided. Although spot welding is preferable as a fixing manner, spot welding creates a problem in that it brings welding distortion to provide misalignment to the subframe 55 after welding. In order to cope with this problem, the subframe 55 has peripheral portions formed with pin holes **55*b* in radial directions, pins 60 are inserted into the pin holes 55*b* to be slidable in radial directions therein, and the pins 60 are fixed to the center shell 51 by spot welding to absorb welding distortion. In that manner, the misalignment due to welding can be restrained. In addition, readjustment can be made by the bolts 59 after welding of the subframe 55 to provide the coaxiality between the frame 50 and the subframe 55. If the readjustment by the bolts 59 is made, the provision of the pin holes 55*b* and the pins 60** may be omitted. Both adjusting means can be combined to ensure the coaxiality with high precision, which is effective when high precision is required like compressors having a small capacity.

Referring now to FIG. 20, there is shown the scroll type compressor according to a fifth embodiment of the present invention. Reference numeral 67 designates a drain oil tube which directs a drain oil from a compression unit. Reference numeral 68 designates a flexible tube which has opposite ends engaged with the drain oil tube 63 and an oil return hole **9*a* for connection. The flexible tube 68** can be made of material such as teflon resin, which is heat resistant, refrigerant resistant, oil resistant etc. Other structure is similar to the conventional scroll type compressors.

The structure of the fifth embodiment wherein the flexible tube 68 is used to connect the drain oil tube 67 and the oil return hole **9*a* can absorb the phase shift in assemblage of the drain oil tube 68 and the oil return hole 9*a* by deformation of the flexible tube 68. In addition, such structure can minimize the gap between the flexible tube 68 and the oil return hole 9*a* to decrease the leakage of the oil through the gap, thereby lowering the sucking amount of the oil by the compressor. Although in the fifth embodiment a part of the drain oil tube 67 is flexible, the drain oil tube 67** may be flexible in its entirety.

We claim:

1. A scroll type compressor comprising:

a fixed scroll and an orbiting scroll which have respective base plates provided with wraps thereon, the wraps being combined to form a compression chamber therebetween;

a frame for fixedly supporting the fixed scroll, the frame having a bearing at a central portion;

a crankshaft supported by the frame bearing to be rotatable, and having an electric motor rotor to give torque to the orbiting scroll;

a subframe having a central portion provided with a bearing for supporting a lower end of the crankshaft;

a center shell having a terminal member and an electric motor stator, having an inner peripheral surface formed with a stepped portion to be engaged with a stepped portion formed on an outer peripheral surface of the frame, the center shell having the frame fixed thereto by shrinkage fit at at least one of a location above the stepped portion and a location below the stepped portion of the center shell, such that a radial force is provided which urges the outer peripheral surface of the frame and the inner peripheral surface of the shell against each other at the shrinkage fit, and wherein said shrinkage fit is immediately adjacent said stepped portion such that the shrinkage fit is provided at least one of immediately above and immediately below the stepped portion of the center shell, the center shell also having the subframe fixed to a lower end thereof; and concentric assemblage jig mounting portions formed in the frame and the subframe, respectively, to be concentric with the bearings.

2. A scroll type compressor according to claim 1, wherein the inner peripheral surface of the center shell includes a machined surface at least at said shrinkage fit.

* * * * *